US005251768A

United States Patent [19]

Yoshimatsu et al.

[11] Patent Number: 5,251,768

[45] Date of Patent: Oct. 12, 1993

[54] METHOD AND DEVICE FOR CONTROLLING BRAKING OF AN UPPER ROTARY BODY OF A CONSTRUCTION MACHINE AND A DEVICE FOR CALCULATING THE INCLINATION ANGLE OF THE UPPER ROTARY BODY

[75] Inventors: Hideaki Yoshimatsu, Akashi; Kouichi Fukushima, Kobe, both of Japan

[73] Assignee: Kabushiki Kaisha Kobe Seiko Sho, Kobe, Japan

[21] Appl. No.: 776,413

[22] PCT Filed: Sep. 25, 1990

[86] PCT No.: PCT/JP90/01232

§ 371 Date: Nov. 25, 1991

§ 102(e) Date: Nov. 25, 1991

[87] PCT Pub. No.: WO91/14645

PCT Pub. Date: Oct. 3, 1991

[30] Foreign Application Priority Data

Mar. 23, 1990 [JP] Japan ..... 2-75294
Aug. 20, 1990 [JP] Japan ..... 2-219689

[51] Int. Cl.[5] ..... B66C 13/50
[52] U.S. Cl. ..... 212/154; 212/245
[58] Field of Search ..... 212/146, 147, 149, 153, 212/154, 157, 223, 230, 231, 232, 238, 245, 255, 261, 264; 340/685

[56] References Cited

U.S. PATENT DOCUMENTS 3,848,750 11/1974 Hoge ..... 212/154
3,921,818 11/1975 Yamagishi .
4,013,174 3/1977 Morrow et al. ..... 212/245
4,515,117 5/1985 Couture et al. ..... 212/154
4,895,262 1/1990 Maso ..... 212/154
5,062,266 11/1991 Yoshimatsu ..... 60/466
5,160,056 11/1992 Yoshimatsu et al. ..... 212/155

FOREIGN PATENT DOCUMENTS 2421613 11/1974 Fed. Rep. of Germany .
3513007 12/1985 Fed. Rep. of Germany .
52-131056 10/1977 Japan .
56-113690 9/1981 Japan .
61-33487 2/1986 Japan .
61-197089 12/1986 Japan .
62-153085 7/1987 Japan .
1048723 11/1966 United Kingdom ..... 212/154

*Primary Examiner*—David M. Mitchell
*Assistant Examiner*—Stephen P. Avila
*Attorney, Agent, or Firm*—Oblon, Spivak, McClelland, Maier & Neustadt

[57] ABSTRACT

A method and device is adapted for controlling rotation of an upper rotary body of a construction machine, the upper rotary body being rotatably mounted on a lower body of the construction machine for lifting a load from a predetermined position thereof. The control is executed by determining, based on the radius of rotation of the lifted load, the weight of the lifted load, the inertia moment of the upper rotary body and the permissible weight of the upper rotary body, a permissible condition not to generate a lateral bending force beyond the lateral bending strength of the upper rotary body, and braking the rotation of the upper rotary body at a rotational angular acceleration satisfying the permissible condition and assuring no-swing of the lifted load. A device is adapted for calculating an inclination angle of the upper rotary body. The calculation is executed by detecting and storing inclination angles of the lower body with respect to two different directions respectively, or detecting and storing inclination angles of the upper rotary body with respect to two different directions respectively when the upper rotary body is at a predetermined reference rotational angle, or detecting and storing inclination angles of the upper rotary body with respect to one direction when the upper rotary body is at two different predetermined reference rotational angles.

17 Claims, 10 Drawing Sheets

METHOD AND DEVICE FOR CONTROLLING BRAKING OF AN UPPER ROTARY BODY OF A CONSTRUCTION MACHINE AND A DEVICE FOR CALCULATING THE INCLINATION ANGLE OF THE UPPER ROTARY BODY

BACKGROUND TECHNOLOGY

The present invention relates to a method and device for braking rotation of an upper rotary body of a construction machine, such as crane, without swinging a lifted load, and also relates to a device for calculating the angle of inclination of the upper rotary body positioned at a given angle of rotation.

In construction machines such as crane equipped with a rotatable boom as upper rotary body, it is important to brake and stop rotation of the upper rotary body without swinging a lifted load. However, the conventional way of stopping rotation of an upper rotary body depends on manual operations by skilled operators. Accordingly, it has been earnestly demanded to reduce their work and ensure more safety.

In addition, in a crane whose rated load is variable according to the direction of rotation, there has been a need to automatically brake and stop rotation of an upper rotary body with preventing the upper rotary body from being subject to an over-load.

In view thereof, Japanese Unexamined Patent Publication No. 61-211295 discloses a device including a sensor, as observer, for measuring the swinging amount of load to thereby carry out feedback control of the speed of rotation based on measurements obtained by the sensor.

It is, however, difficult to brake and stop the rotation of an upper rotary body properly by such feedback control because the swinging amount of load with the rotation of the upper rotary body is affected by external conditions such as wind. Moreover, it is very difficult to measure the swinging amount with a high precision. Accordingly, such feedback control is considered to be impracticable.

It is desirable to brake and stop the rotation of an upper rotary body as quickly as possible. On the other hand, however, the braking of an upper rotary body at a greater deceleration causes the load and the upper rotary body itself to have greater inertia force in the direction of the rotation. Consequently, the upper rotary body is subject to a greater load in the direction of lateral bending.

Moreover, a load in the direction of lateral bending is greatly dependent on the inclination angle of the upper rotary body. Accordingly, it is very important to detect the inclination angle with a high precision when controlling the stop and rotation of an upper rotary body.

Specifically, construction machines such as cranes equipped with an upper rotary body are not always placed in a perfectly horizontal position. In the case of mobile cranes and the like, especially, the setting place is often changed, and there are many cases in which they are operated in slightly inclined positions. As operation in such inclined positions delicately gives an influence to the stability and strength of the machines, a control has been demanded which takes this influence into account.

In connection with this influence, Japanese Unexamined Patent Publication No. 59-172385 discloses a device in which the inclination angle of a crane body is detected with respect to a forward and backward direction or sideways direction of a crane, and the operation radius of the crane is changed based on the detected inclination angle.

Also, Japanese Unexamined Patent Publication No. 59-227688 discloses a device in which the inclination angle of a crane body is detected, and one of two predetermined rated loads is selected according to the detected inclination angle.

Further, Japanese Unexamined Patent Publication No. 62-13620 discloses a device including a sensor provided on an upper rotary body for detecting the inclination angle, whereby braking is applied to the upper rotary body according to the inclination angle detected by the sensor at every moment.

Such conventional technology, however, have the following problems which must be solved:

In the devices of Japanese Unexamined Patent Publication Nos. 59-172385 and 59-227688, the inclination angle of a crane body with respect to a forward and backward direction or sideways direction is detected, and the operation radius of the crane or the rated load is changed based on the detected inclination angle. However, it is not the inclination angle of the crane body which is in direct connection with the operation radius and the rated load, but it is the inclination angle of the upper rotary body, which changes with rotation. Accordingly, it could be seen to be ideal that an upper rotary body is controlled based on the inclination angle of the upper rotary body.

In the above-mentioned devices, however, an operation radius or rated load is set based on an initially detected inclination angle of the crane body. Consequently, it is difficult to carry out controls in accordance with actual rotation. Accordingly, to ensure the safety of a crane, the operation radius must be set at a greater value, or the rated load must be set at a smaller value, which results in a problem that the permissible operation range of a crane is unnecessarily limited smaller.

On the other hand, in the device of Japanese Unexamined Patent Publication No. 62-13620, the sensor for detecting the inclination angle is provided on the upper rotary body. Accordingly, the inclination angle of the upper rotary body can be directly detected at every moment. However, this device can obtain the inclination angle only at that moment of detection. Accordingly, it is difficult to carry out proper control of rotation of an upper rotary body.

For example, if the upper rotary body is inclined, the lateral bending load will act on the upper rotary body due to the inclination. Consideration of the lateral bending load involves limitation of the operational range of the upper rotary body. Accordingly, control of the upper rotary body is automatically taken so as not to go beyond the limit. In this device, in which the inclination angle of the upper rotary body is detected at every moment, the lateral bending load is calculated at every moment based on the detected inclination angle, and compared with the rated load. However, it will be seen to be too late to start the application of braking to the upper rotary body at the moment when the lateral bending load reaches the rated load. If braking is applied at that time, the upper rotary body will stop at a position beyond the position for the rated load due to the inertia force. In other words, a proper timing of braking the upper rotary body cannot be precisely found out from the direct detection of the inclination angle of the upper rotary body as stated above. Actually, it is necessary to carry out such control as starting the braking much earlier to give some leeway.

Also, the operator cannot obtain the permissible operation range of a crane beforehand. Accordingly, the operator cannot but continue his crane operation uneasily without knowing when the automatic braking will be started or how much more load can be handled in the present operation. Thus, it is very inconvenient.

DISCLOSURE OF THE INVENTION

It is an object of the present invention to solve the above-mentioned problems. For the object, the present invention provide a method for controlling rotation of an upper rotary body of a construction machine, the upper rotary body being rotatably mounted on a lower body of the construction machine for lifting a load from a predetermined position thereof. Specifically, the method load, the inertia moment of the upper rotary body and the permissible weight of the upper rotary body, a permissible condition not to generate a lateral bending force beyond the lateral bending strength of the upper rotary body, and braking the rotation of the upper rotary body at the rotational angular acceleration $\beta$ defined by the following equation to stop the rotation of the upper rotary body;

$$\beta = -\omega \cdot \Omega o / 2n \cdot \pi$$

wherein n denotes a minimum one of natural numbers satisfying the permissible condition, $\Omega o$ denotes the angular velocity of the upper rotary body before braking, and $\omega$ is represented as follows;

$$\omega = \sqrt{g/l}$$

wherein g denotes the acceleration of gravity, and l denotes the radius of swing of the lifted load.

Also, the present invention provides a device for controlling rotation of the upper rotary body. The device comprises drive means for rotating the upper rotary body, permissible condition determination means for determining, based on the radius of rotation of the lifted load, the weight of the lifted load, the inertia moment of the upper rotary body and the permissible weight of the upper rotary body, a permissible condition not to generate a lateral bending force beyond the lateral bending strength of the upper rotary body, rotational angular acceleration bending force beyond the lateral bending strength of the upper rotary body, rotational angular acceleration calculator means for calculating a rotational angular acceleration $\beta$ of the upper rotary body in accordance with the above-mentioned equation, and controller means for controlling the rotation of the upper rotary body at the calculated rotational angular acceleration $\beta$ to stop the upper rotary body.

With these constructions, the permissible condition is determined based on the permissible weight of the upper rotary body and the other factors, and a proper rotational angular acceleration is then calculated which satisfies the permissible condition, and enables the upper rotary body to be stopped without involving any swing of the lifted load and for a shorter period of time. Thereafter, the upper rotary body is braked to stop at the calculated rotational angular acceleration.

Further, the present invention provides a device for calculating an inclination angle of the upper rotary body. The device comprises lower body inclination angle detector means provided on the lower body for detecting inclination angles of the lower body with respect to two different directions respectively, and upper rotary body inclination angle calculator means for calculating, based on the detected inclination angles, an inclination angle of the upper rotary body when the upper rotary body is at a given rotational angle.

With this construction, the inclination angle of the upper rotary body positioned at a given rotational angle is calculated based on the inclination angles of the lower body detected by the lower body inclination angle detector means.

Furthermore, the present invention provides a device for calculating an inclination angle of the upper rotary body rotatably mounted on the lower body comprising upper rotary body inclination angle detector means provided on the upper rotary body for detecting inclination angles of the upper rotary body with respect to two different directions respectively, inclination angle memory means for storing inclination angles of the upper rotary body which are detected by the upper rotary body inclination angle detector means when the upper rotary body is at a predetermined reference rotational angle, and upper rotary body inclination angle calculator means for calculating, based on the stored inclination angles, an inclination angle of the upper rotary body when the upper rotary body is at a given rotational angle.

With this construction, the upper rotary body is rotated to the predetermined reference rotational angle at which inclination angles of the upper rotary body are then detected by the upper rotary body inclination angle detector means and stored in the inclination angle memory means, and an inclination angle of the upper rotary body positioned at a given rotational angle is calculated based on the stored inclination angles.

Furthermore, the present invention provides a device for calculating an inclination angle of the upper rotary body rotatably mounted on the lower body comprising upper rotary body inclination angle detector means provided on the upper rotary body for detecting an inclination angle of the upper rotary body with respect to one direction, inclination angle memory means for storing inclination angles of the upper rotary body which are detected by the upper rotary body inclination angle detector means when the upper rotary body is at two different predetermined reference rotational angles, and upper rotary body inclination angle calculator means for calculating, based on the stored inclination angles, an inclination angle of the upper rotary body when the upper rotary body is at a given rotational angle.

With this construction, the upper rotary body is rotated to one of the two different predetermined reference rotational angles at which an inclination angle of the upper rotary body is then detected by the upper rotary body inclination angle detector means and stored in the inclination angle memory means, and the upper rotary body is further rotated to the other predetermined reference rotational angle at which an inclination angle of the upper rotary body is then detected by the upper rotary body inclination angle detector means and stored in the inclination angle memory means, and an inclination angle of the upper rotary body positioned at a given rotational angle is calculated based on the stored inclination angles.

Figure 5:
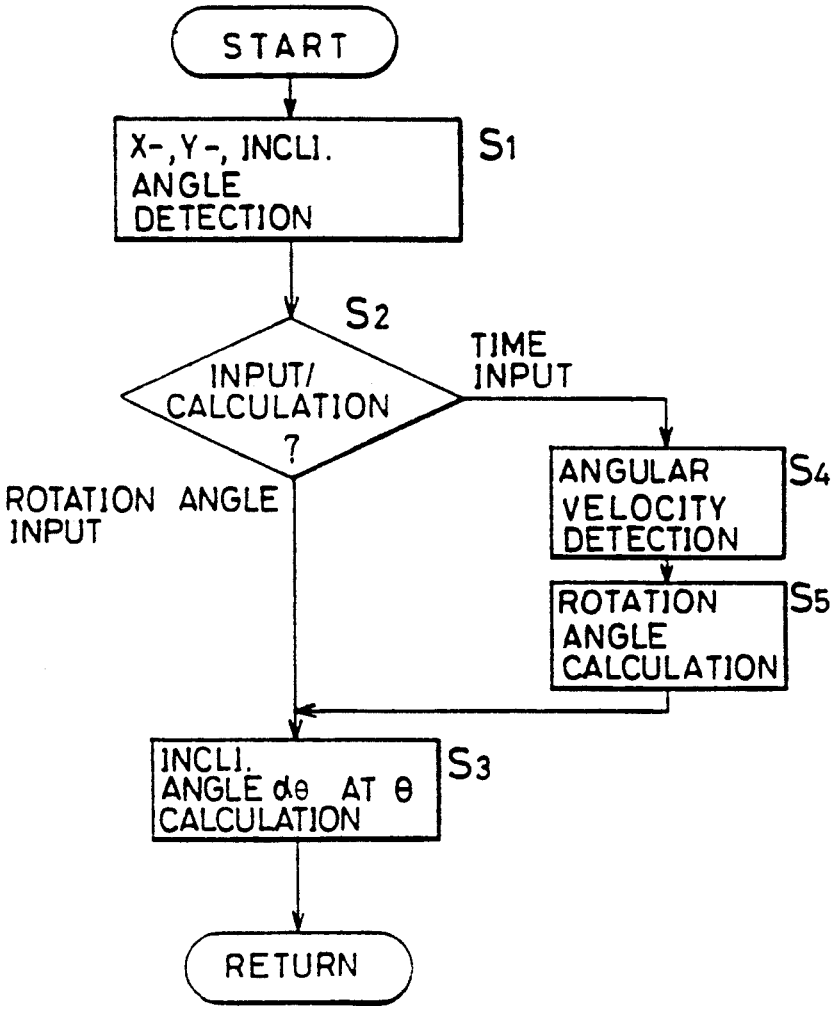
Figure 3:
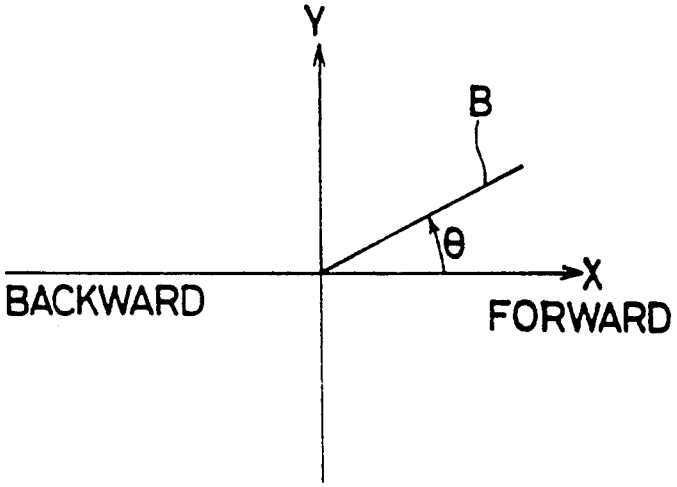
Figure 4:
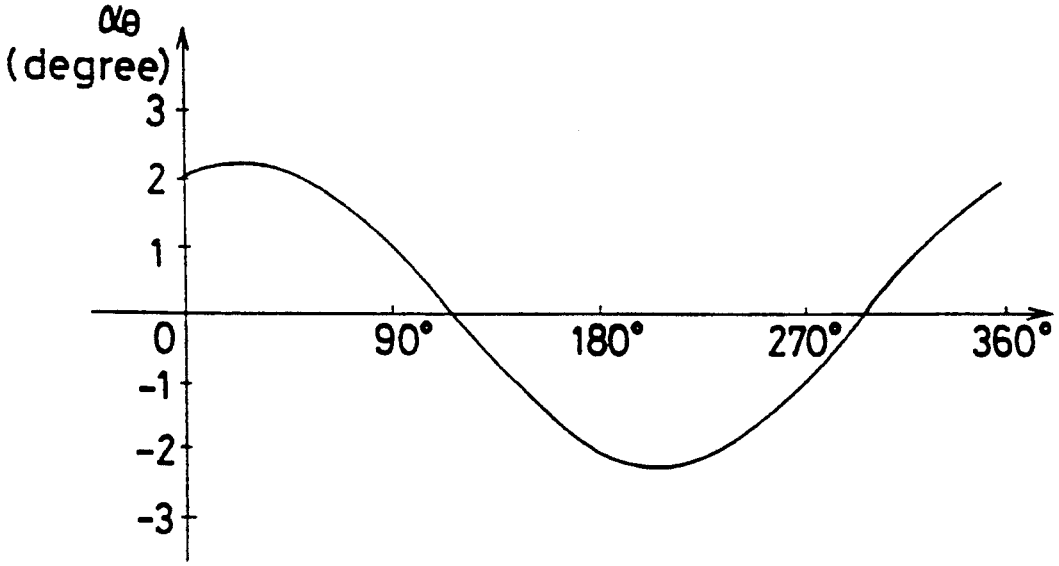
Figure 6:
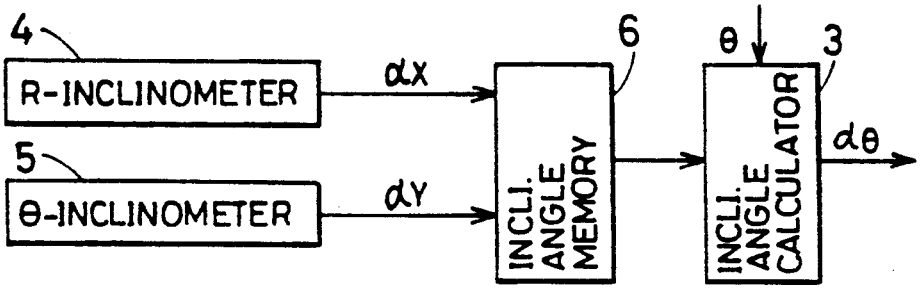
Figure 7:
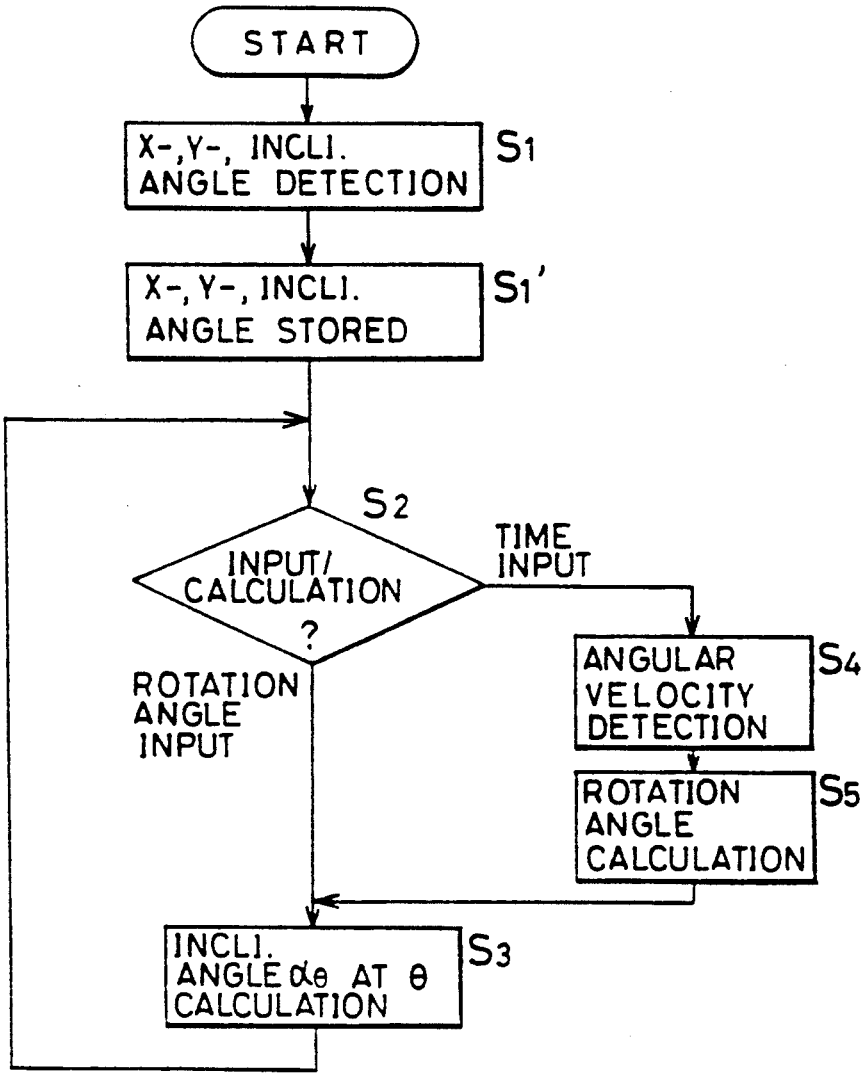
Figure 8:
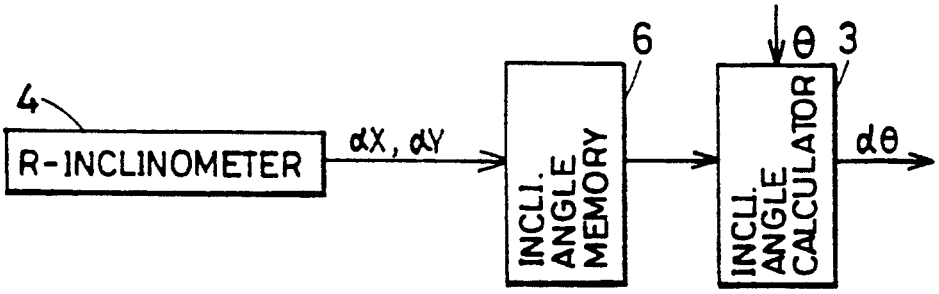
Figure 9:
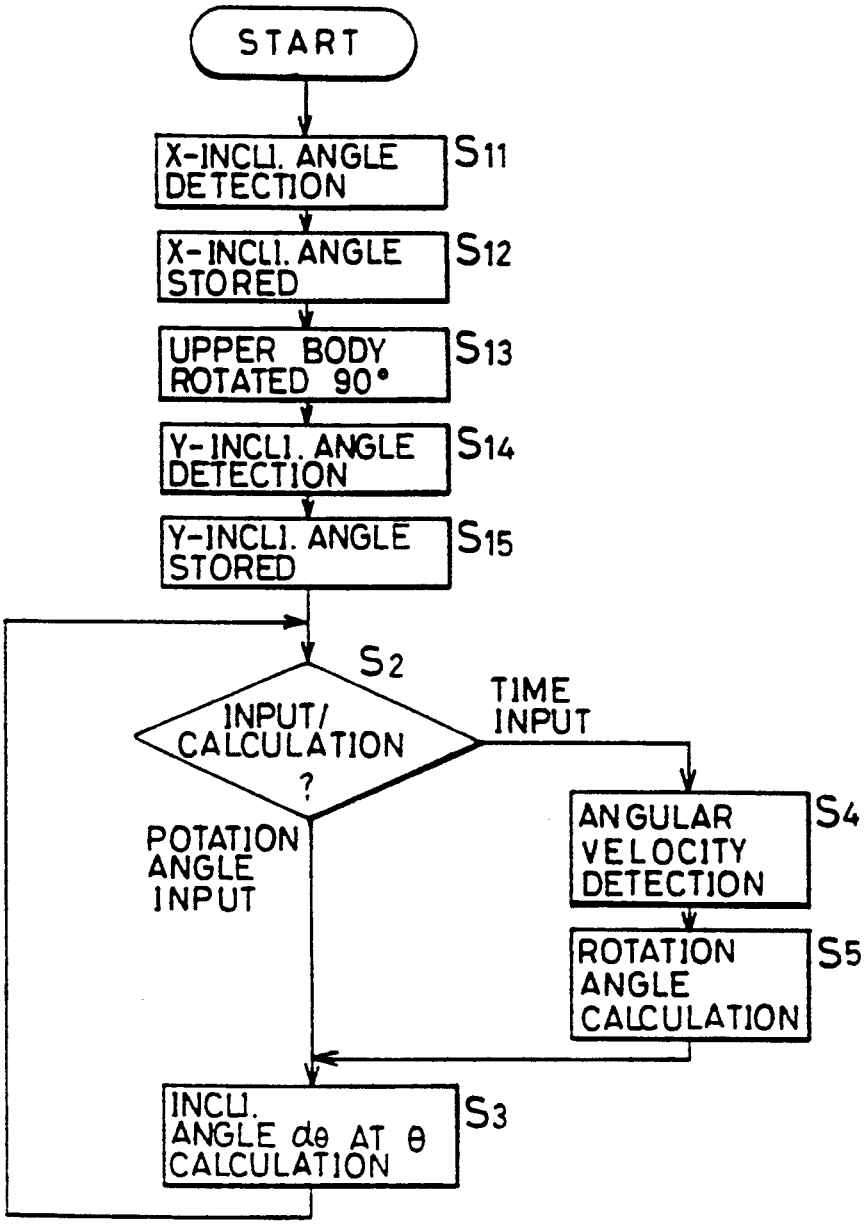
Figure 10:
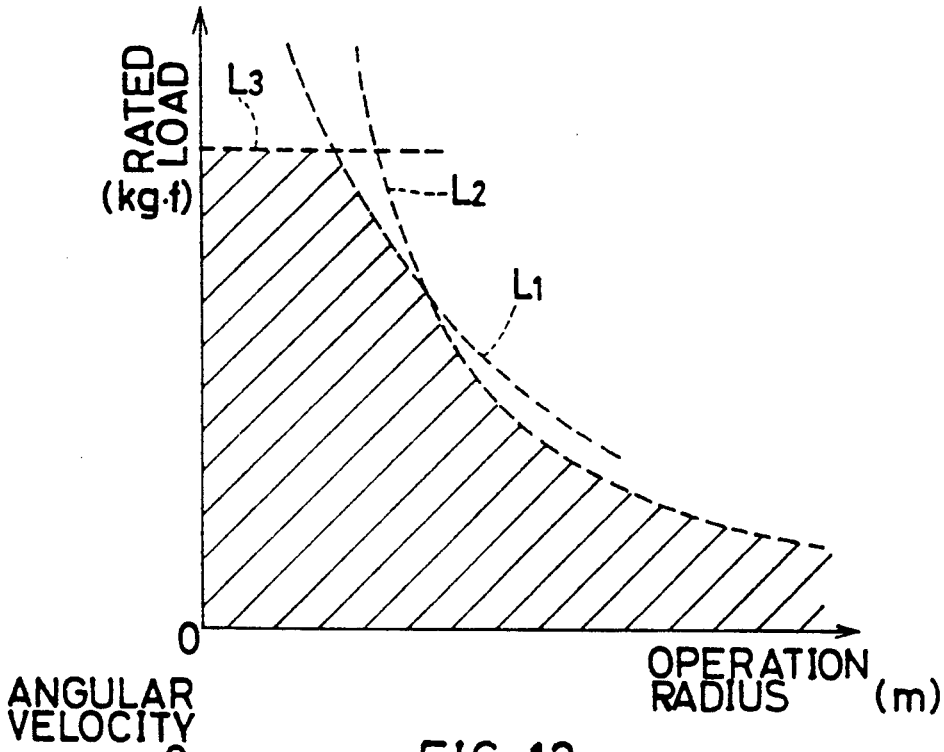
Figure 13:
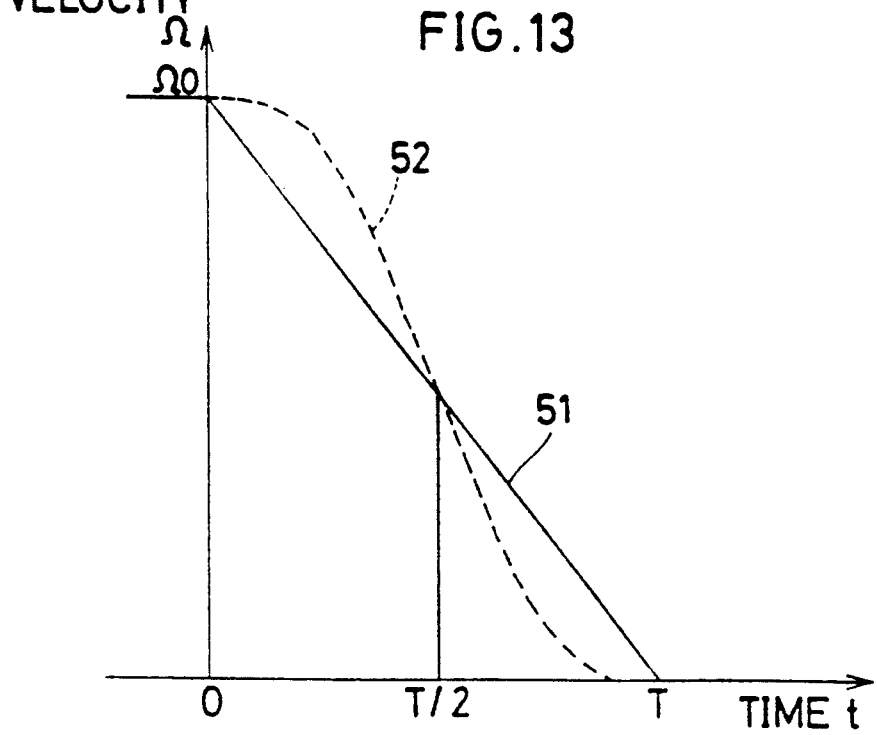
Figure 11:
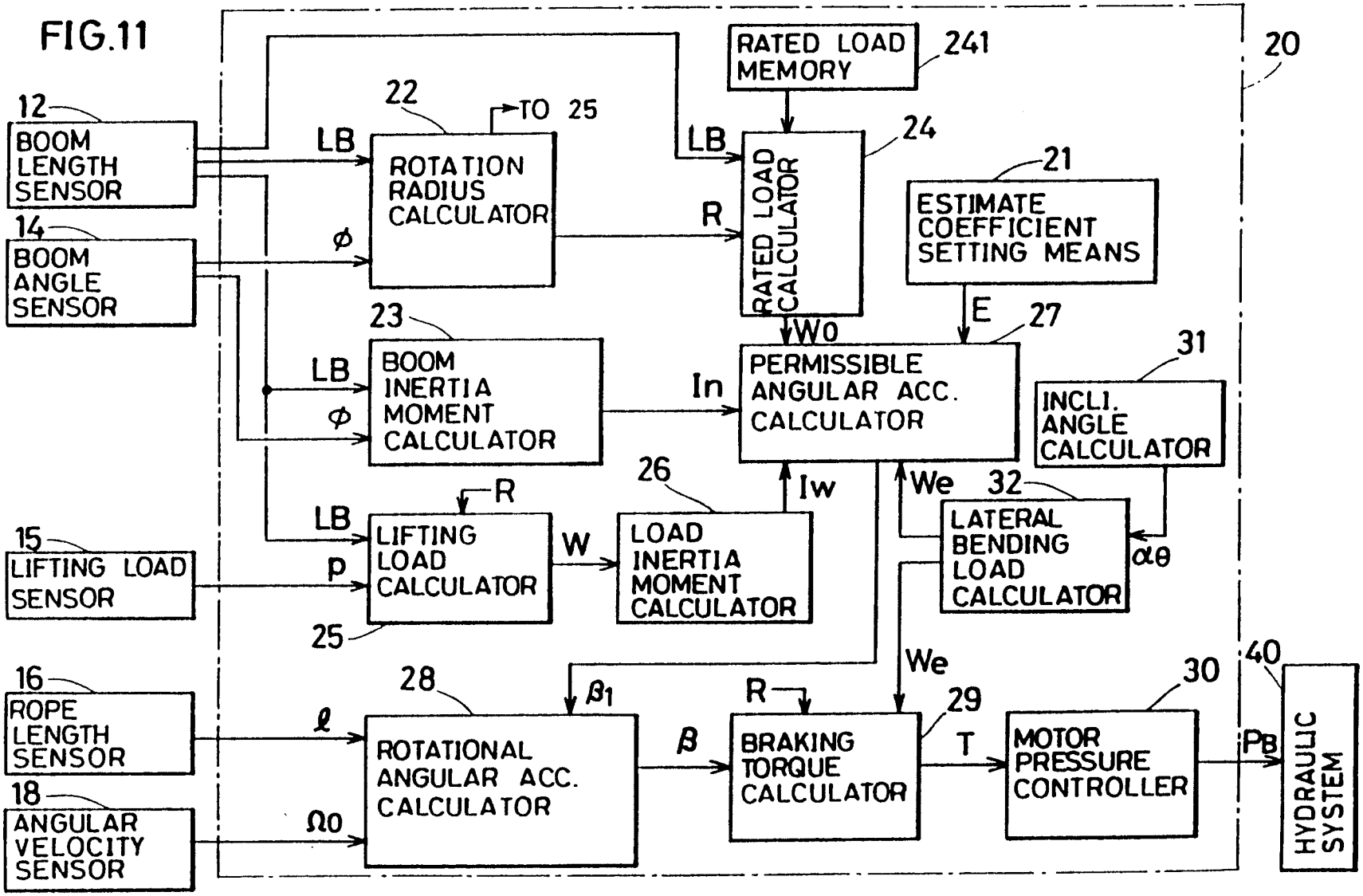
Figure 12:
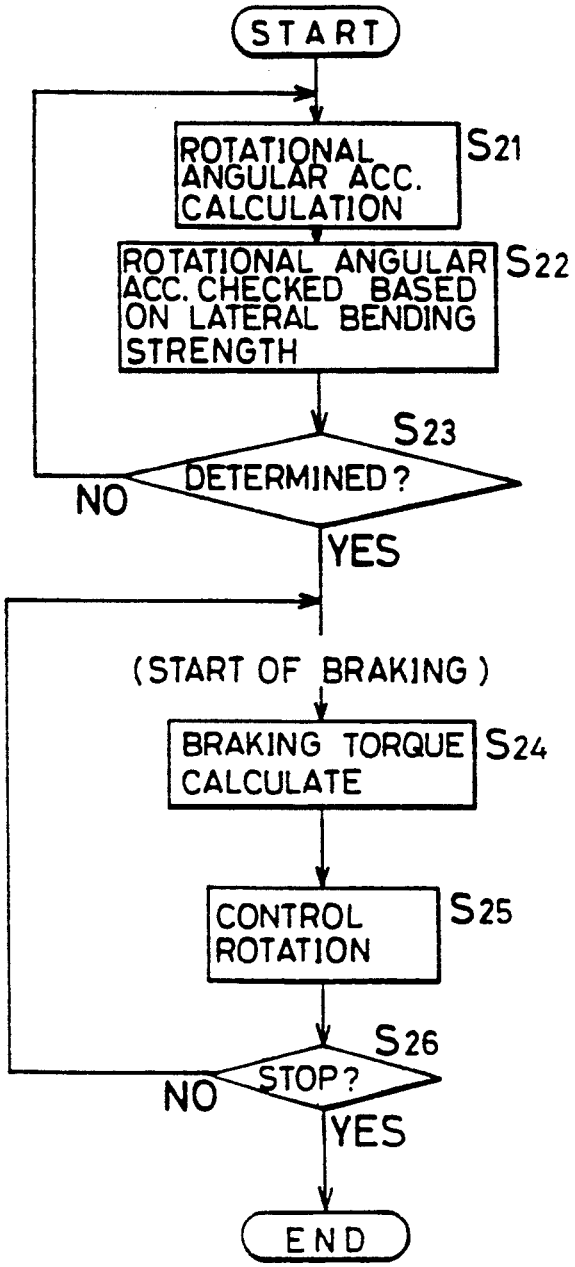
Figure 14:
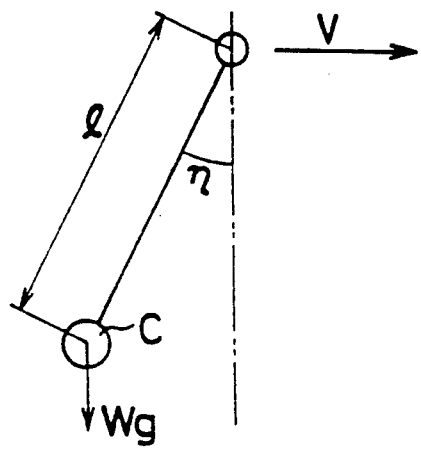
Figure 15:
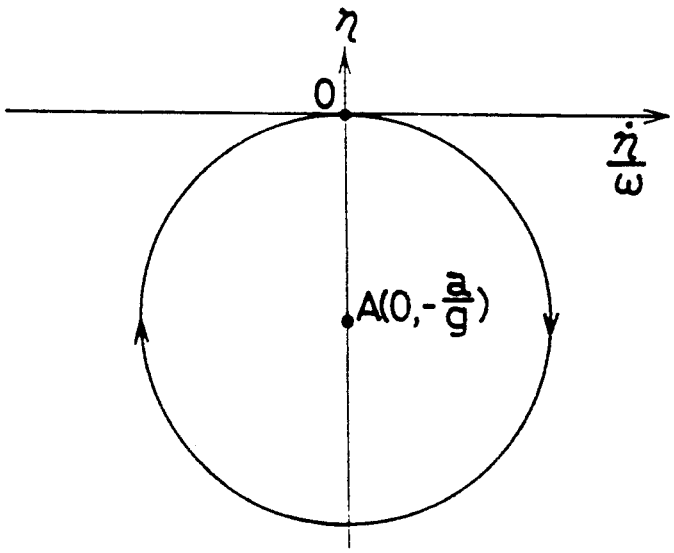
Figure 16:
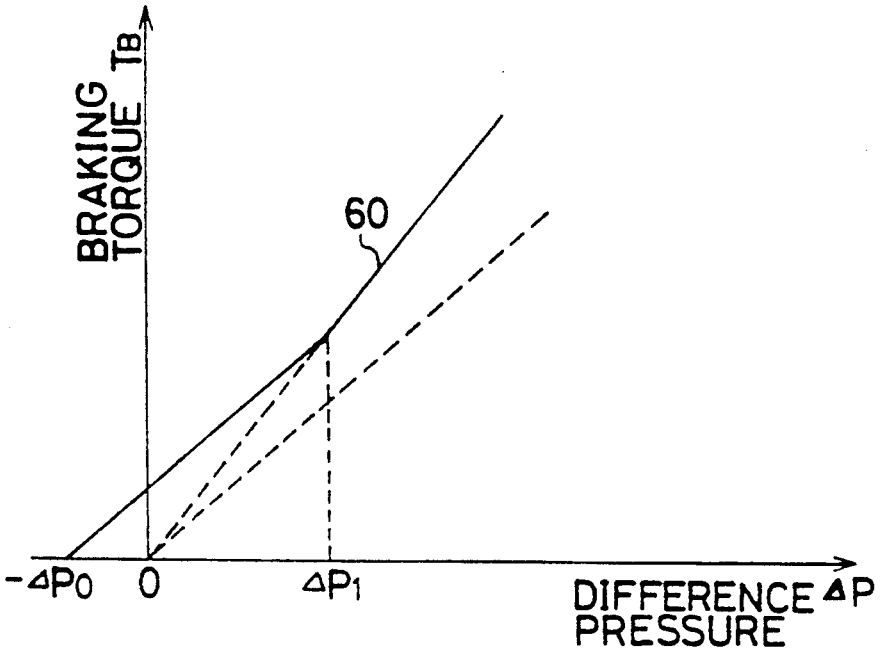

FIG .2(*b*) is a side elevation view of the crane;

FIG. 3 is a plan diagram showing a boom direction of the crane in an X-Y coordinate;

FIG. 4 is a graph showing a relationship between the rotation angle of an upper rotary body and the inclination angle of the upper rotary body;

FIG. 5 is a flowchart showing calculating operations of the first inclination angle calculation device;

FIG. 6 is a diagram showing a functional construction of a second inclination angle calculation device of the present invention;

FIG. 7 is a flowchart showing calculating operations of the second inclination angle calculation device;

FIG. 8 is a diagram showing a functional construction of a third inclination angle calculation device of the present invention;

FIG. 9 is a flowchart showing a calculating operation of the third inclination angle calculation device;

FIG. 10 is a graph showing a relationship between the operation radius of the crane and the rated load;

FIG. 11 is a diagram showing a functional construction of a device provided on the crane for controlling the rotation of the upper rotary body;

FIG. 12 is a flowchart showing control operations of the braking controlling device;

FIG. 13 is a graph showing characteristics curves of the angular acceleration change of a lifted load and the angular acceleration change of the upper rotary body when braking;

FIG. 14 is a diagram showing a state of a lifted load in the form of a single pendulum model;

FIG. 15 is a graph showing a relationship between the swinging angle of the lifted load and the swinging speed, the relationship being represented in a topological space; and FIG. 16 is a graph showing a relationship between the differential pressure of a hydraulic motor and the braking torque.

BEST MODE FOR CARRYING OUT THE INVENTION

Figure 2B:
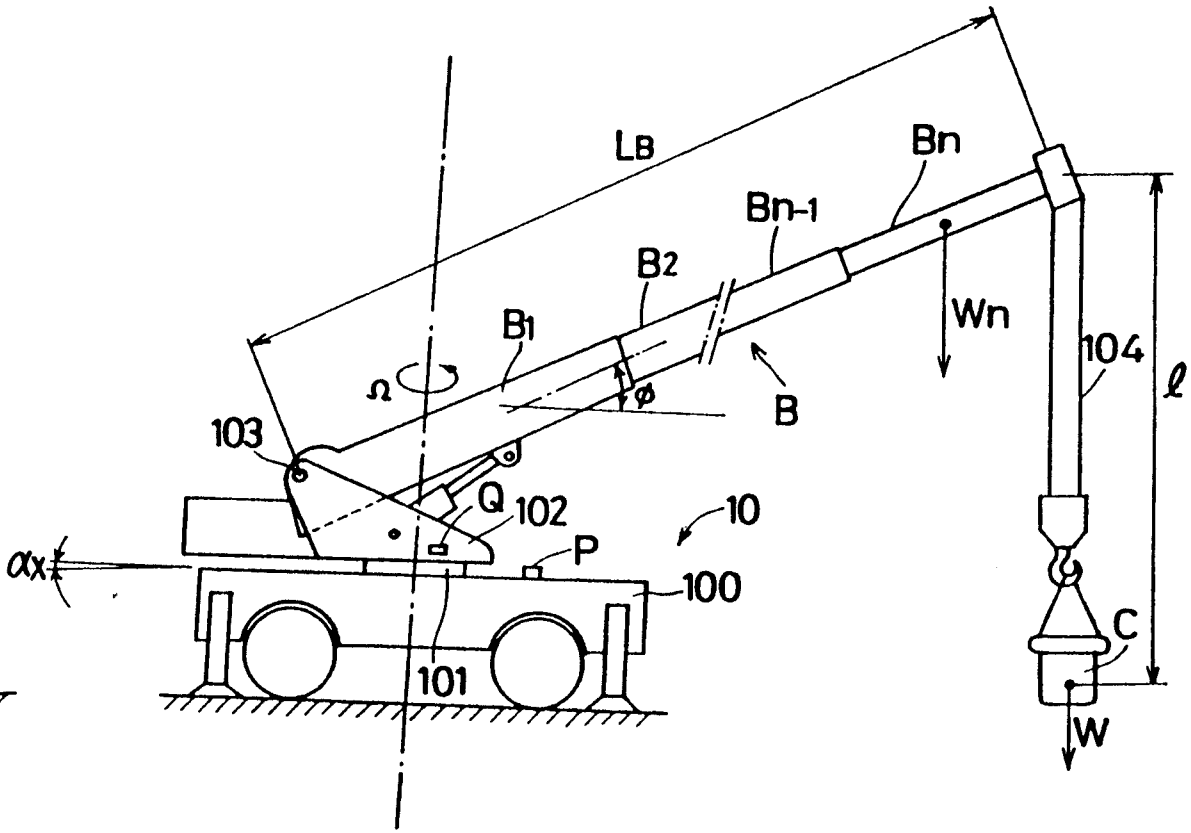
FIG. 2(*a*) is a front elevation view of a crane provided with the first inclination angle calculation device.
Figure 2A:
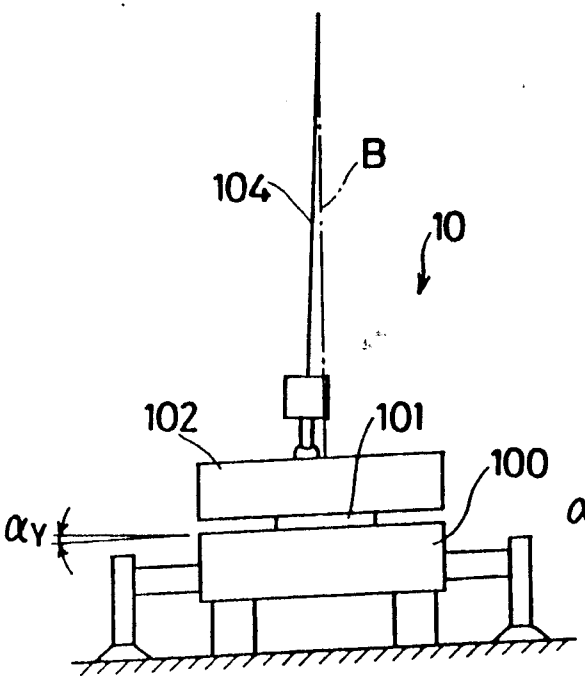

FIGS. 2(*a*) and (*b*) show a mobile crane, an example of construction machines, provided with a device for controlling rotation of an upper rotary body and an inclination angle calculation device of the present invention. It should be noted that the present invention is not limited to such mobile crane, but is applicable for any construction machine including a lower body and an upper rotary body rotatably mounted on the lower body.

A crane 10 shown in FIGS. 2(*a*) and (*b*) includes a boom foot 102 rotatable about a vertical pivot 101. The boom foot 102 carries an expandable boom B consisting of boom members B1 to Bn. These parts constitute an upper rotary body rotatable over the lower body 100. The expandable boom B is pivotable about a horizontal pivot 103. A load C is lifted from a forward end of the expandable boom B with a rope 104. In the following description, Bn (n=1,2, . . . n) represents the n-th boom member from the boom foot 102.

Figure 1:
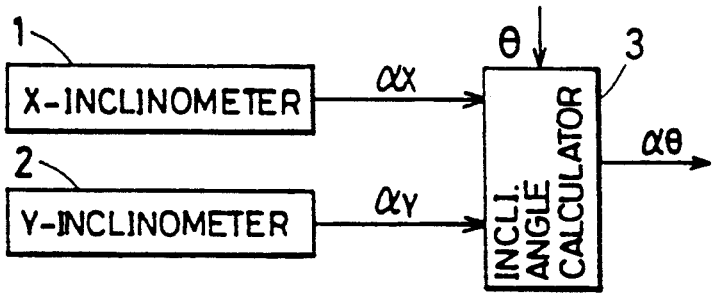
FIG. 1 is a diagram showing a functional construction of a first inclination angle calculation device of the present invention.

FIG. 1 shows an inclination angle calculation device provided on the crane 10.

An X-direction inclinometer 1 and a Y-direction inclinometer 2 are provided at appropriate positions of the lower body 100, for example, the point P on the boom foot 102 in FIG. 2(*b*). The X-direction inclinometer 1 is adapted for detecting the inclination angle $\alpha x$ of the lower body 100 in its forward and backward direction as shown in FIG. 2(*b*) and the Y-direction inclinometer 2 is adapted for detecting the inclination angle $\alpha y$ of the lower body 100 in its sideways direction as shown in FIG. 2(*a*). In the following description, $\alpha x>0$ means that the lower body 100 rises forward, and $\alpha y>0$ means that the lower body 100 rises toward the left side.

An inclination angle calculator 3 includes a microcomputer, and calculates the inclination angle of the upper rotary body at a given rotation angle (the inclination angle $\alpha\theta$ of the upper rotary body in the rotational direction in this embodiment) based on the inclination angles $\alpha x$ and $\alpha y$ detected by the X-direction inclinometer 1 and the Y-direction inclinometer 2 respectively. In the following description, the rotation angle $\theta$ of the upper rotary body means the angles of counterclockwise rotation of the boom B relative to the X-axis. The rotation angle $\theta$ is expressed by degrees. The X-axis, as shown in FIG. 3, is along the forward and backward direction of the crane body. The Y-axis is along the sideways direction of the crane body.

Specifically, the inclination angle $\alpha\theta$ of the upper rotary body can be calculated from the inclination angles $\alpha x$ and $\alpha y$ of the lower body 100, and rotation angle $\theta$ as follows:

$$\tan \alpha\theta = -\tan \alpha x \cdot \sin \theta + \tan \alpha y \cdot \cos \theta \quad (1)$$

wherein, $\alpha\theta$, $\alpha x$, and $\alpha y$ are each around 3°, which are considerably small. Accordingly, the following equations can be taken:

$$\tan \alpha\theta = (\pi/180)\cdot\alpha\theta$$

$$\tan \alpha x = (\pi/180)\cdot\alpha x$$

$$\tan \alpha y = (\pi/180)\cdot\alpha y$$

If these equations are substituted for the corresponding terms in Equation (1), and both sides are divided by $\pi/180$, the following equation can be obtained.

$$\alpha\theta = -\alpha x \cdot \sin \theta + \alpha y \cdot \cos \theta \quad (2)$$

If, for example, $\alpha x=-1°$, $\alpha y=2°$, the graph shown in FIG. 4 can be obtained.

According to Equation (2), the inclination angle calculator 3 calculates and outputs the inclination angle $\alpha\theta$ of the upper rotary body at a given rotation angle $\theta$.

FIG. 5 is a flowchart showing operations of the inclination angle calculation device. First, the inclination angles $\alpha x$ and $\alpha y$ are respectively detected by the X-direction inclinometer 1 and the Y-direction inclinometer 2 (Step S1). Subsequently, a desired rotation angle $\theta$ is determined (Step S2). In the case that the desired rotation angle $\theta$ is inputted directly, the inclination angle $\alpha\theta$ corresponding to the desired rotation angle $\theta$ is calculated immediately (Step S3). On the other hand, in the case that time t to elapse from the present time is considered for the determination of rotation angle $\theta$, the angular velocity $\omega$ of the upper rotary body is firstly detected (Step S4), and a rotation angle $\theta$ at the moment when the time t has elapsed is calculated based on the detected angular velocity $\omega$ (Step S5). Then, the inclination angle $\alpha\theta$ of the upper rotary body corresponding to the calculated rotation angle $\theta$ is calculated (Step S6).

This device can provide the inclination angle $\alpha\theta$ of the upper rotary body positioned at an arbitrary rotation angle $\theta$. This device can obtain a future inclination angle $\alpha\theta$ as well as the present one. Accordingly, as described later, proper braking control of the upper rotary body can be carried out based on the inclination angle $\alpha\theta$ which is calculated by this device.

In the above-mentioned embodiment, the inclinometers are adapted for detecting the inclination angle of the lower body in the X-direction and the Y-direction. However, it should be noted that the present invention, the inclinometers are not limited for the detection of inclination angles in the X-direction and Y-direction, but may be used for the detection of inclination angles in at least two different directions to calculate the inclination angle of the upper rotary body.

Also, it should be noted that the inclination angle of the upper rotary body is not limited to the above-mentioned calculation of the inclination angle in the rotational direction of the upper rotary body, but may be calculated in any direction. For example, the inclination angle $\alpha r$ of the upper rotary body in a longitudinal direction of the boom B is calculated, and the operational radius of the boom B is corrected based on the calculated inclination angle $\alpha r$. This can be similarly applied to the following embodiments.

A second inclination angle calculation device will be described with reference to FIG. 6 and FIG. 7.

In the second embodiment, an R-direction inclinometer 4 and a $\theta$-direction inclinometer 5 as shown in FIG. 6 are provided at a position Q on the boom foot 102 in FIG. 2, for example. The R-direction inclinometer 4 is adapted for detecting the inclination angle of the upper rotary body in the direction of the boom B (i.e., the forward and backward direction of the upper rotary body). The $\theta$-direction inclinometer 5 is adapted for detecting the inclination angle of the upper rotary body in the rotational direction of the upper rotary body (i.e. the sideways direction of the upper rotary body).

Also, there is provided an inclination angle memory 6 for storing the inclination angle of the upper rotary body detected by the R-direction inclinometer 4 when the upper rotary body is at a reference position where the boom-direction of the upper rotary body meets the X-direction of the lower body (i.e., the inclination angle $\alpha x$ of the lower body 100 in the X-direction), and the inclination angle of the upper rotary body detected by the $\theta$-direction inclinometer 5 when the upper rotary body is at the same position (i.e. the inclination angle $\alpha y$ of the lower body 100 in the Y-direction). An inclination angle calculator 3 calculates the inclination angle $\alpha\theta$ of the upper rotary body in the rotational direction based on the inclination angles $\alpha x$ and $\alpha y$ stored in the memory 6 in accordance with Equation (2).

FIG. 7 is a flowchart showing operations of the second inclination angle calculation device. First, the upper rotary body is rotated to the reference position, where the boom-direction of the upper rotary body meets the X-direction of the lower body, and the inclination angle $\alpha x$ of the upper rotary body in the boom-direction (i.e., the X-direction of the lower body) is detected by the R-direction inclinometer 4, and the inclination angle $\alpha y$ of the upper rotary body in the rotational direction (i.e., the Y-direction of the lower body) is detected by the $\theta$-direction inclinometer 5 (Step S1). These inclination angles $\alpha x$, $\alpha y$ are stored in the inclination angle memory 6 (Step S1'). Subsequently, the inclination angle $\alpha\theta$ of the upper rotary body in the rotational direction at a given rotation angle $\theta$ is calculated based on the stored inclination angles $\alpha x$ and $\alpha y$ in Steps S2 to S5 similarly to those of the flowchart shown in FIG. 5.

As shown in this embodiment, even if the inclinometers 4 and 5 are provided on the upper rotary body, the inclination angle of the upper rotary body at a given rotation angle can be obtained by detecting and storing the inclination angle of the upper rotary body at the reference position, and carrying out the calculation based on the stored inclination angles.

It should be noted that the reference position at which the upper rotary body is put in the initial state is not limited in the position where the boom-direction of the upper rotary body meets the X-direction of the lower body, but may be properly selected. For example, the reference position may be set at the position where the boom-direction of the upper rotary body meets the Y-direction of the lower body. At this reference position, the inclination angle $\alpha y$ of the upper rotary body in the Y-direction is detected by the R-direction inclinometer 4, and the inclination angle $\alpha x$ of the upper rotary body in the X-direction is detected by the $\theta$-direction inclinometer 5.

A third inclination angle calculation device will be described with reference to FIG. 8 and FIG. 9.

In the third embodiment, an inclinometer for detecting the inclination angle of the upper rotary body in one direction, e.g., an R-direction inclinometer 4, is provided on the upper rotary body. This inclinometer detects inclination angles of the upper rotary body positioned at different two reference positions respectively. These detected two inclination angles are stored in an inclination angle memory 3.

Specific operations of the third inclination angle calculation device is shown in a flowchart of FIG. 9. Similarly to the second embodiment, first, the upper rotary body is rotated to the first reference position where the boom-direction of the upper rotary body meets the X-direction of the lower body. In this state, the inclination angle $\alpha x$ of the upper rotary body in the X-direction of the lower body is detected by the R-direction inclinometer 4 (Step S11), and then stored in the inclination angle memory 6 (Step S12). Next, the upper rotary body is rotated 90 degrees (Step S13) and is set at the second reference position where the boom-direction of the upper rotary body meets the Y-direction of the lower body. In this state, the inclination angle $\alpha y$ of the upper rotary body in the Y-direction of the lower body is detected by the R-direction inclinometer 4 (Step S14), and then stored in the inclination angle memory 6 (Step S15). Thereafter, the inclination angle $\alpha\theta$ of the upper rotary body in the rotational direction at a given rotation angle $\theta$ is calculated based on the stored inclination angles $\alpha x$ and $\alpha y$ in Steps S2 to S5 similarly to those of the flowcharts shown in FIGS. 5 and 7.

As shown in this embodiment, even if only one inclinometer is provided on the upper rotary body, the inclination angle of the upper rotary body at a given rotation angle can be obtained by rotating the upper rotary body to the two different reference positions, and detecting and storing the inclination angle of the upper rotary body at the two different reference positions, and carrying out the calculation based on the stored inclination angles.

Accordingly, this embodiment in which only one inclinometer is provided makes it possible to calculate the inclination angle of the upper rotary body at a reduced cost.

In this embodiment, the R-direction inclinometer 4 is used as only one inclinometer. However, the direction in which the inclination angle is detected is not limited in the boom-direction, but may be set in a desired direction. For example, in the case that a $\theta$-direction inclinometer is provided, the same result can be obtained as the case of the R-direction inclinometer.

The above-mentioned inclination angle calculation devices are useful to control rotation of the boom B as described later. Also, these devices have advantageous effect for determination of a permissible operation range in consideration of static lateral bending loads which the boom receives due to an inclination of the lower body.

In general, the rated lifting load for a crane is determined in accordance with the graph shown in FIG. 10 under the conditions that the length of the boom and the extending amount of the outrigger jack are kept constant. In the graph, a curve L1 represents a restriction curve which refers to the strength of the boom B and is determined taking into account a load increase caused with an increase in the operational radius. A curve L2 represents a restriction curve which refers to the stability and is determined taking into account instability of the crane from falling due to an increase in the operational radius. A curve L3 represents a restriction curve which refers to the absolute upper limit of the rated load. The shaded portion inside these curves L1–L3 represents the permissible operational range of the crane.

However, if the crane itself is in an inclined position, the boom B receives a static lateral bending load due to the inclination of the upper rotary body in the rotational direction. Accordingly, the strength of the crane should be assessed taking into consideration not only the above-mentioned rated lifting load but also the lateral bending load. Specifically, according to the regulation on the construction of mobile crane, within 5 percent of the rated load should be limited the lateral bending load acting on a position of the upper rotary body where the greatest bending moment occurs, i.e., in general, a lateral bending load acting on the forward end of the boom.

It could be seen that proper braking control, which takes into consideration lateral bending loads, can be realized by calculating the inclination angle $\alpha\theta$ of the upper rotary body with the use of the above-mentioned inclination angle calculation device, and calculating the lateral bending load acting on the boom B based on the calculated inclination angle.

Specifically, assuming that the weight of a lifted load C is W (kgf); the weight of the i-th boom member Bi is WBi (kgf); the horizontal distance between the gravity center of the i-th boom member Bi and the rotation axis is LBi(m); the horizontal distance between the forward end of the boom B and the rotation axis is r(m), the maximum load We acting on the forward end of the boom B at the inclination angle $\alpha\theta$ of the upper rotary body in the rotational direction can be represented as follows.

$$We = \left( W + \frac{\sum_{i=1}^{N} WBi \cdot LBi}{r} \right) \cdot \sin\alpha\theta \tag{3}$$

As mentioned above, the inclination angle calculation device makes it possible to execute proper braking control which is based on an actual maximum lateral bending load We of the position where the maximum bending moment occurs. Accordingly, the rated load is not required to set at an unnecessary greater value based on the inclination angle of the lower body. Such setting has conventionally been made. Therefore, the advantage can be attained of expanding the permissible operation range to its maximum with considering forces equivalent to actual lateral bending loads.

Also, the maximum load We at a given rotation angle $\theta$ of the upper rotary body can be calculated in advance, and the permissible operation range of the crane can be consequently determined in advance without actually rotating the upper rotary body. Accordingly, the upper rotary body can assuredly be stopped within the permissible operation range by braking the upper rotary body to have a proper angular acceleration at a predetermined rotation angle before the limit of the permissible operation range.

Further, the operator has an advantage of knowing how much more leeway he has for the present work and being able to continue the work without any worry because the permissible operation range is determined in advance.

Next, a braking control device to be provided on the upper rotary body of the crane 10 will be described. On the crane 10, the inclination angle calculation device is provided so as to carry out braking control considering the lateral bending load caused due to the inclination of the upper rotary body.

Recently, there have been worked out braking control devices for stopping a boom without swinging a load C lifted from the boom. In such braking control devices, there has been one in which the calculation is executed in advance of obtaining a rotational angular acceleration $\beta$ to assure the ceasing of swing of a lifted load when the boom is entirely stopped, and the braking of the upper rotary body is carried out based on the calculated angular acceleration $\beta$. However, when the braking is carried out, a lateral bending load acts on the boom due to the fact that the upper rotary body has an inertia force. Further, the lateral bending load varies with the absolute value of the rotational angular acceleration $\beta$. Accordingly, it will be seen that an appropriate rotational angular acceleration $\beta$ should be selected considering not only the swing of the load C but also the permissible lateral bending load.

Moreover, in the case where the crane is operated in an inclined state, a static lateral bending load acts on the boom following the inclination angle $\alpha\theta$ of the upper rotary body in the direction of rotation as mentioned earlier. Accordingly, this static lateral bending load should be considered with the lateral bending load caused by the braking. In other words, to carry out a proper braking control even in the state where the crane is in an inclined position, it is important to know in advance the inclination angle of the upper rotary body at a given rotation angle. Accordingly, the above-mentioned inclination angle calculation device is useful for this case.

It should be noted that a braking control device of the present invention is successfully applicable for braking control not considering the inclination angle of the upper rotary body as mentioned earlier.

FIG. 11 shows a functional construction of the braking control device using the inclination angle calculation device.

The braking control device includes a boom length sensor 12, boom angle sensor 14, lifted load weight sensor 15, rope length sensor 16, angular velocity sensor 18, calculation/control unit 20, and hydraulic system 40 for rotation. The calculation/control unit 20 includes means 21 for setting the estimate coefficient for lateral bending, means 22 for calculating the rotation radius, means 23 for calculating the inertia moment of the boom, means 24 for calculating the rated load, means 25 for calculating the lifted load, means 26 for calculating the inertia moment of the load, means 27 for calculating the permissible angular acceleration, means 28 for calculating the rotational angular acceleration, means 29 for calculating the braking torque, means 30 for controlling the motor pressure, means 31 for calculating the inclination angle 31, and means 32 for calculating the lateral bending load.

The estimate coefficient setting means 21 is adapted for setting estimate coefficient E with respect to the lateral bending stregth of the boom B.

The rotation radius calculator means 22 calculates the rotation radius R of the load C based on the boom length LB and the boom angle $\phi$ (the lifting angle of the boom) detected by the boom length sensor 12 and the boom angle sensor 14 respectively.

The boom inertia moment calculator means 23 calculates the inertia moment In of each boom member Bn based on the boom length LB and the boom angle $\phi$.

The rated load calculator means 24 calculates the rated load Wo based on the rotation radius R calculated by the rotation radius calculator means 22, the boom length LB, and data stored in a rated load memory 241.

The lifted load calculator means 25 calculates an actual lifted load W based on the pressure p of the hydraulic cylinder for lifting the boom which is detected by the lifted load sensor 15, the rotation radius R calculated by the rotation radius calculator means 22, and the boom length LB.

The load inertia moment calculator means 26 calculates the inertia moment Iw of the load C based on the lifted load W calculated by the lifted load calculator means 25 and the rotation radius R.

The permissible angular acceleration calculator means 27 calculates the permissible angular acceleration $\beta 1$ based on the lateral bending stregth of the boom B from the load inertia moment Iw, the boom inertia moment In, the rated load Wo, the estimate coefficient E, and the load We calculated by the lateral bending load calculator means 32.

The rotational angular acceleration calculator means 28 calculates the rotational angular acceleration $\beta$ to actually brake the rotation of the rotary body based on the swing radius l of the load C which is obtained by the rope length sensor 16, the rotational angular velocity $\omega o$ of the boom B which is obtained by the angular velocity sensor 18, and the permissible angular acceleration $\beta 1$.

The braking torque calculator means 29 calculates the braking torque T to stop the boom B at the rotational angular acceleration $\beta$ taking into consideration the operation radius R and the load We.

The motor pressure control means 30 determines the braking pressure PB of a hydraulic motor based on the braking torque T, and sends a control signal to the hydraulic system 40.

The inclination angle calculator means 31 includes one of the earlier-described inclination angle calculation devices, and calculates the inclination angle $\alpha\theta$ of the upper rotary body in the rotation direction at a given rotation angle $\theta$ based on the detected results from one or more inclinometers.

The lateral bending load calculator means 32 calculates the lateral bending load We acting on the forward end of the boom by substituting the calculated inclination angle $\alpha\theta$ in Equation (3).

Next, calculation and control operations of the braking control device will be described with reference to a flowchart shown in FIG. 12.

First, the rotation radius calculator means 22 obtains a rotation radius R' not including a deflection of the boom B and a radius increase $\Delta R$ caused by the deflection of the boom B based on the boom length LB and the boom angle $\phi$, and then calculates the rotation radius R from thus calculated rotation radius R' and radius increase $\Delta R$.

The boom inertia moment calculator means 23 calculates the inertia moment In of each boom member Bn in accordance with the following equation:

$$In = Ino \cdot \cos^2\phi + (Wn/g) \cdot Rn^2$$

wherein Ino denotes the inertia moment (constant) of each boom member Bn about the gravity center when $\phi = 0$; Wn denotes the dead weight of each boom part; g denotes the gravity acceleration; Rn denotes the rotation radius of each boom member Bn about the gravity center.

On the other hand, the load inertia moment calculator means 26 calculates the load inertia moment Iw based on the lifted load W and the above-calculated rotation radius R. Specifically, the load inertia moment Iw can be represented by the following equation:

$$Iw = (W/g)R^2$$

The permissible angular acceleration calculator means 27 calculates the permissible angular acceleration $\beta 1$ based on the calculated data as follows.

In general, the boom B and the boom foot 102 of the crane 10 have sufficient strengths. However, when the boom B is expanded longer, a greater lateral bending force acts on the boom B due to the inertia force caused at the moment of braking and the inclination of the lower body. In respect of the strength against lateral bending force, a portion near the boom foot 102 most receives the influence. Therefore, the strength against lateral bending force is estimated based on the moment about the vertical pivot 101.

Specifically, a moment Nb which is caused by the rotation and acts on the center of rotation can be represented as follows:

$$Nb = Nc + Nw + Ns \quad (4)$$

wherein Nc denotes a moment caused on the upper rotary body by the inertia force; Nw denotes a moment caused on the lifted load C by the inertia force; Ns denotes a moment caused by the inclination of the crane 10. Assuming that the rotational angular acceleration of the boom B is $\beta'$, and the rotational angular acceleration of the load C is $\beta''$, these moments Nc, Nw, and Ns can be obtained in the following equations:

$$Nc = \left( \sum_{n=1}^{N} In + Iu \right) \cdot \beta' \tag{4a}$$

$$Nw = Iw \cdot \beta'' = (W/g) \cdot R^2 \cdot \beta'' \tag{4b}$$

$$Ns = We \cdot R \cdot \sin\alpha\theta \tag{4c}$$

wherein W denotes the weight of the lifted load C and Iu denotes the inertia moment of the parts of the upper rotary body other than the boom B.

The permissible condition concerning the strength of the boom B against lateral bending force can be represented as follows:

$$Nb/R \leqq E \cdot Wo \tag{5}$$

Also, the relationship between the rotational angular acceleration $\beta'$ of the upper rotary body and the rotational angular acceleration $\beta''$ of the lifted load C can be represented by the following equation:

$$\beta'' = \beta' \left( 1 - \cos\sqrt{\frac{l}{g}}\, t \right) \tag{7}$$

FIG. 13 shows the angular velocity $\Omega c$ of the upper rotary body and the angular velocity $\Omega w$ of the lifted load C. The angular velocity $\Omega c$ is shown by a solid line 51 while the angular velocity $\Omega w$ is shown by a broken line 52. In this graph, represented at $\Omega 0$ is the angular velocity of the upper rotary body and lifted load C before being braked, and at T the time taken to stop the upper rotary body from starting of the braking. Also, the natural number n which is used in the later-described Equation (13) is 1. FIG. 13 clearly shows the relationship between the rotational angular acceleration $\beta'$ and the rotational angular acceleration $\beta''$, which is shown in Equation (7). A maximum rotational angular acceleration $\beta'$ which satisfies Equations (4), (5) and (7) is determined as the permissible angular acceleration $\beta 1$.

Although the rotational angular acceleration $\beta''$ is calculated in accordance with Equation (7), it may be approximately calculated as $\beta''=k\beta'$ by setting an appropriate coefficient k.

The coefficient k will be set as follows. As shown in FIG. 13, the angular velocity $\Omega c$ of the upper rotary body decreases constantly or linearly. However, the angular velocity $\Omega w$ of the lifted load C decreases slowly immediately after starting the braking and immediately before the complete stop, and decreases abruptly in an intermediate time. In other words, the angular velocity $\Omega w$ of the lifted load C oscillates one cycle until the upper rotary body is perfectly stopped. The angular velocity $\Omega w$ becomes the same as the angular velocity $\Omega c$ of the upper rotary body when the time has elapsed $t=T/2$ from the start time of the braking. At this moment, also, the rotational angular acceleration $\beta''$ of the lifted load C is twice the rotational angular acceleration $\beta'$ of the upper rotary body. In the case where the natural number n is 2 or more, the gradient of the angular velocity $\Omega c$ of the upper rotary body is 1/n. Accordingly, the angular velocity $\Omega w$ of the lifted load C oscillates n cycles from the start time of the braking to the complete stop. However, similarly to the case where the natural number n is 1, when the rotational angular acceleration $\beta''$ of the lifted load C is in the minimum (maximum if the absolute value is adopted), the rotational angular acceleration $\beta''$ is twice the rotational angular acceleration $\beta'$ of the upper rotary body.

Accordingly, the safety of the crane can be theoretically assured by executing the calculation on the assumption that $\beta''=2\beta'$. However, there is actually a case where the lifted load C swings when the braking is started. In such a case, the rotational angular acceleration $\beta''$ of the lifted load C rises beyond twice the rotational angular acceleration $\beta'$ of the upper rotary body. Therefore, in practical use, to assure the safety of the crane, it is preferable to execute the calculation on the assumption that $\beta''=k\beta'$, wherein the coefficient k is more than 2.

The estimate coefficient E may be set at a constant value. Also, in consideration of the deflection of the boom B and so on, the estimate coefficient E can be set at a smaller value as the length LB and rotational radius R of the boom B are longer. For example, a construction regulation for mobile cranes provides: "The value of a horizontally moving load should be calculated assuming that the load equivalent to 5 percent of the weight of horizontally movable parts of the crane, and the load equivalent to 5 percent of the rated load act in the same direction and at the same time."

The rotational angular acceleration calculator means 28 calculates an actual rotational angular acceleration $\beta$ based on the calculated permissible angular acceleration $\beta 1$, the swinging radius l of the lifted load C and the angular velocity $\Omega o$ (angular velocity before deceleration) of the upper rotary body, which are obtained from the rope length sensor 16 and the angular velocity sensor 18 respectively.

The following description will be made on the calculation of actual rotational angular acceleration $\beta$.

Regarding the motion of the load C lifted by the crane 10, first, a single pendulum model shown in FIG. 14 is adopted. This system can be represented by the following differential equation:

$$\ddot{\eta} + (g/l)\eta = -V/l \tag{10}$$

$$V = Vo + at \tag{11}$$

wherein $\eta$ denotes the swinging angle of the lifted load C; V denotes the rotational velocity of a particular point of the boom B, the rotational velocity changing with time t; Vo denotes the rotational velocity ($=R\Omega o$) before the start time of the braking of the particular point; a denotes the acceleration of the rotational velocity Vo.

Both sides of Equation (11) are differentiated by time t, and substituted for the term on the right side of Equation (10). The obtained Equation is integrated on initial conditions ($\eta=0$ and $\dot{\eta}=0$ at $t=0$). Consequently, the following Equation (12) can be obtained.

$$(\dot{\eta}/\omega)^2 + (\eta + a/g)^2 = (a/g)^2 \tag{12}$$

wherein $\omega=\sqrt{g/l}$

This equation can be drawn on a topological plane of $\dot{\eta}/\omega$ and $\eta$ in the form of a circle having a center point A (0, $-a/g$) and passing the origin (0, 0) as shown in FIG. 15. The period T of the pendulum is represented by the circle around the center point A. The period T during which the single pendulum starts from the initial position and returns to the initial position again can be represented as $T=2\pi/\omega$. Accordingly, it will be seen that if the rotational angular acceleration $\beta$ is set at such a value that the upper rotary body will completely stop in nT(n: natural number) from the moment (point 0) of starting the braking control, the upper rotary body can be stopped without leaving any swing of the lifted load C. The above-mentioned $\omega$ is a constant value which is to be determined by the gravity acceleration g and the swing radius l. Accordingly, the rotational angular acceleration $\beta$ which assures the braking control without leaving any swing of the lifted load C can be calculated in accordance with the following equation:

$$\begin{aligned}\beta &= -\Omega o/n \cdot T \\ &= -\omega \cdot \Omega o/2n \cdot \pi \ (n\text{: natural number})\end{aligned} \tag{13}$$

Also, with respect to the lateral bending strength of the boom B, there is the condition $|\beta| \leqq \beta 1$. Accordingly, in Step S22 in the flowchart of FIG. 12, it is discriminated whether the absolute value $|\beta|$ of the above-calculated rotational angular acceleration is equal or smaller than the permissible angular acceleration $\beta 1$. Next, in Step S23, it is executed to select a minimum natural number n from the natural numbers which can provide rotational angular accelerations satisfying this condition.

After that, the braking is actually started based on the obtained rotational angular acceleration $\beta$. First, the braking torque calculator means 29 calculates a braking torque Tb necessary to execute the braking at the above-mentioned rotational angular acceleration $\beta$ in Step S24. This braking torque Tb can be obtained in the following equation:

$$Tb = Tc + Tw + Ts \tag{14}$$

wherein Tc denotes the torque to apply the braking to the upper rotary body; Tw denotes the torque to apply the braking to the lifed load C; Ts denotes the torque to resist against a load caused by the inclination of the crane. They can be represented as follows:

$$Tc = \left| \left( \sum_{n=1}^{N} In + Iu \right) \cdot \beta \right| \tag{14a}$$

$$Tw = |Iw \cdot \beta_2| = |(W/g) \cdot R^2 \cdot \beta_2| \tag{14b}$$

$$Ts = |We \cdot R \cdot \sin\alpha\theta| \tag{14c}$$

It should be noted that $\beta_2$ is the rotational angular acceleration of the lifted load C, and can be calculated using the rotational angular acceleration $\beta$ of the upper rotary body in the following equation:

$$\beta_2 = -\beta \cdot (1 - \cos\sqrt{l/g} \cdot t) \tag{7}$$

The motor pressure controller means 30 sets a hydraulic motor pressure Pb based on the braking torque Tb, and sends a control signal to the hydraulic system 40 to execute the braking of the upper rotary body (Step S25).

The following is one of calculations of the hydraulic motor pressure Pb. As stated above, the torque Tb necessary to execute the braking can be calculated in the following equation:

$$Tb = Tc + Tw + Ts \tag{14}$$

The torque Tb has a relationship with a condition of the hydraulic motor (difference pressure $\Delta P$) as shown by a solid line 60 in FIG. 16. This relationship can be represented as follows:

i) In the case where $-\Delta Po \leqq \Delta P < \Delta P1$ $$Tb = (\Delta P + \Delta Po) \cdot QH/200\pi \tag{15}$$

ii) In the case where $\Delta P \geqq \Delta P1$ $$Tb = (\Delta P \cdot QH/200\pi) \cdot io \cdot \eta m \tag{16}$$

wherein QH: Capacity of the motor
io: Net deceleration ratio
$\eta m$: Mechanical efficiency
$\Delta Po$: Lost pressure of the motor when no load is applied The motor difference pressure $\Delta P1$ shows the value of $\Delta P$ at the point where the straight line obtained by Equation (15) and the straight line obtained by Equation (16) intersect each other.

Accordingly, the difference pressure $\Delta P$ of the hydraulic motor can be obtained by substituting Equation (15) or (16) for Equation (14).

Also, when the driving pressure of the hydraulic motor is Pa, the braking pressure Pb of the hydraulic motor can be obtained as follows:

$$Pb = Pa + \Delta P \tag{17}$$

The above-mentioned braking control is executed until the upper rotary body completely stops (Step S26). Consequently, the upper rotary body can be automatically stopped without leaving any swing of the lifted load and receiving an excessive lateral bending load.

This braking controlling device can be applied to any type of construction machine provided with an upper rotary body from which a load can be lifted. Also, in any hydraulic driving means or any electrical driving means, by setting a rotational angular acceleration as mentioned above, safe braking can be accomplished which involves no swing of the lifted load.

In the case of a crane whose rated load is varied in accordance with the direction of rotation, it should be noted that it is, as a matter of course, necessary to detect the angle of rotation and detect setting conditions of the crane, for example, the width of jutting out of outriggers.

According to the present invention, also, the permissible angular acceleration $\beta 1$ is not necessarily required to be calculated. For example, in this embodiment, by selecting a rotational angular acceleration $\beta$ which satisfies Equation (5), the same result can be obtained.

THE POSSIBILITY OF APPLICATION IN INDUSTRY

As we have seen, the present invention is effective in controlling the rotation of an upper rotary body so as to stop it without swinging the load. Also, the present invention makes it possible to apply braking to the upper rotary body to stop for a shorter time taking account of the lateral bending strength of the upper rotary body.

The present invention is also useful in calculating the inclination angle of the upper rotary body. Specifically, the present invention can provide the inclination angle of the upper rotary body positioned at a given rotation angle beforehand without actually rotating the upper rotary body to respective rotation angles. Therefore, a proper operation range of the upper rotary body can be efficiently determined taking the inclination angle into consideration. Accordingly, the operation range can be expanded more than conventional ones. Moreover, braking of the upper rotary body can be properly executed based on the inclination angle. The present invention can contribute to proper braking control for construction machines to a greater extent.

What is claimed is:

1. A method for controlling rotation of an upper rotary body of a construction machine, the upper rotary body being rotatably mounted on a lower body of the construction machine for lifting a load from a predetermined position thereof, the method comprising the steps of:

determining, based on a radius of rotation of the lifted load, the weight of the lifted load, the inertia moment of the upper rotary body and a permissible weight of the upper rotary body, a permissible condition which does not generate a lateral bending force beyond the lateral bending strength of the upper rotary body;

braking the rotation of the upper rotary body at a rotational angular acceleration $\beta$ defined by the following equation to stop the rotation of the upper rotary body;

$$\beta = -\omega \cdot \Omega o / 2n \cdot \pi$$

wherein n denotes a minimum one of natural numbers satisfying the permissible condition $\Omega o$ denotes the angular velocity of the upper rotary body before braking, and $\omega$ is represented as follows;

$$\omega = \sqrt{g/l}$$

wherein g denotes the acceleration of gravity, and l denotes the radius of swing of the lifted load.

2. A method according to claim 1 wherein the permissible condition is a permissible range of rotational angular accelerations.

3. A method according to claim 1 wherein the permissible condition is determined based on the inclination angle of the upper rotary body in addition to the radius of rotation of the lifted load, the weight of the lifted load, the inertia moment of the upper rotary body and the permissible weight of the upper rotary body.

4. A device for controlling rotation of an upper rotary body of a construction machine, the upper rotary body being rotatably mounted on a lower body of the construction machine for lifting a load from a predetermined position thereof, the device comprising:

drive means for rotating the upper rotary body;

permissible condition determination means for determining, based on a radius of rotation of the lifted load, the weight of the lifted load, the inertia moment of the upper rotary body and a permissible weight of the upper rotary body, a permissible condition which does not generate a lateral bending force beyond the lateral bending strength of the upper rotary body;

rotational angular acceleration calculator means for calculating a rotational angular acceleration $\beta$ of the upper rotary body in accordance with the following equation;

$$\beta = -\omega \cdot \Omega o / 2n \cdot \pi$$

wherein n denotes a minimum one of natural numbers satisfying the permissible condition, $\Omega o$ denotes the angular velocity of the upper rotary body before braking, and $\omega$ is represented as follows;

$$\omega = \sqrt{g/l}$$

wherein g denotes the acceleration of gravity, and l denotes a radius of swing of the lifted load; and controller means for controlling the rotation of the upper rotary body at the calculated rotational angular acceleration $\beta$ to stop the upper rotary body.

5. A device according to claim 4 wherein the permissible condition determination means determines a permissible range of rotational angular accelerations.

6. A device according to claim 4 wherein the permissible condition determination means determines the permissible condition based on the inclination angle of the upper rotary body in addition to the radius of rotation of the lifted load, the weight of the lifted load, the inertia moment of the upper rotary body and the permissible weight of the upper rotary body.

7. A device according to claim 4 wherein the driver means includes a hydraulic motor, and the controller means includes braking torque calculator means for calculating a braking torque to stop the upper rotary body at the calculated rotational angular acceleration, and motor pressure controlling means for setting a braking pressure of the hydraulic motor based on the calculated braking torque, and outputting a control signal.

8. A device according to one of the preceding claims wherein the construction machine is a mobile crane carrying a boom.

9. A device for calculating an inclination angle of an upper rotary body of a construction machine, the upper rotary body being rotatably mounted on a lower body of the construction machine, the device comprising:

lower body inclination angle detector means provided on the lower body for detecting inclination angles of the lower body with respect to two different directions respectively; and upper rotary body inclination angle calculator means for calculating, based on the detected inclination angles, an inclination angle of the upper rotary body when the upper rotary body is at a given rotational angle.

10. A device according to claim 9 wherein the lower body inclination angle detector means includes:

an X-direction inclinometer for detecting an inclination angle of the lower body with respect to a forward and backward direction of the lower body; and a Y-direction inclinometer for detecting an inclination angle of the lower body with respect to a sideways direction of the lower body.

11. A device for calculating an inclination angle of an upper rotary body of a construction machine, the upper rotary body being rotatably mounted on a lower body of the construction machine, the device comprising:

upper rotary body inclination angle detector means provided on the upper rotary body for detecting inclination angles of the upper rotary body with respect to two different directions respectively;

inclination angle memory means for storing inclination angles of the upper rotary body which are detected by the upper rotary body inclination angle detector means when the upper rotary body is at a predetermined reference rotational angle; and upper rotary body inclination angle calculator means for calculating, based on the stored inclination angles, an inclination angle of the upper rotary body when the upper rotary body is at a given rotational angle.

12. A device according to claim 11 wherein the upper rotary body inclination angle detector means includes:

an R-direction inclinometer for detecting an inclination angle of the upper rotary body with respect to a forward and backward direction of the upper rotary body; and a $\theta$-direction inclinometer for detecting an inclination angle of the upper rotary body with respect to a sideways direction of the upper rotary body.

13. A device for calculating an inclination angle of an upper rotary body of a construction machine, the upper rotary body being rotatably mounted on a lower body of the construction machine, the device comprising:

upper rotary body inclination angle detector means provided on the upper rotary body for detecting an inclination angle of the upper rotary body with respect to one direction;

inclination angle memory means for storing inclination angles of the upper rotary body which are detected by the upper rotary body inclination angle detector means when the upper rotary body is at two predetermined reference rotational angles different from each other; and upper rotary body inclination angle calculator means for calculating, based on the stored inclination angles, an inclination angle of the upper rotary body when the upper rotary body is at a given rotational angle.

14. A device according to claim 13 wherein the upper rotary body inclination angle detector means includes an R-direction inclinometer for detecting an inclination angle of the upper rotary body with respect to a forward and backward direction of the upper rotary body.

15. A device according to one of the preceding claims 9 to 14 wherein the upper rotary body inclination angle calculator means calculates an inclination angle of the upper rotary body with respect to a sideways direction of the upper rotary body.

16. A device according to one of the preceding claims 9 to 14 wherein the construction machine is a mobile crane carrying a boom.

17. A device according to claim 15 wherein the construction machine is a mobile crane carrying a boom.

* * * * *